US009073227B2

(12) United States Patent
Weber

(10) Patent No.: US 9,073,227 B2
(45) Date of Patent: Jul. 7, 2015

(54) BLADE FOR PROVIDING A CUT AT FOOD PRODUCTS

(75) Inventor: Günther Weber, Groβ Nemerow (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 853 days.

(21) Appl. No.: 13/146,745

(22) PCT Filed: Dec. 17, 2009

(86) PCT No.: PCT/EP2009/009091

§ 371 (c)(1),
(2), (4) Date: Oct. 27, 2011

(87) PCT Pub. No.: WO2010/086007

PCT Pub. Date: Aug. 5, 2010

(65) Prior Publication Data

US 2012/0036971 A1 Feb. 16, 2012

(30) Foreign Application Priority Data

Jan. 30, 2009 (DE) ..... 10 2009 006 911

(51) Int. Cl.
*B26D 1/34* (2006.01)
*B26D 1/00* (2006.01)
*B26D 1/43* (2006.01)
(Continued)

(52) U.S. Cl.
CPC ..... *B26D 1/0006* (2013.01); *B26D 1/43* (2013.01); *B26D 1/44* (2013.01); *B26D 3/16* (2013.01); *B26D 7/016* (2013.01); *B26D 9/00* (2013.01); *B26D 2001/006* (2013.01)

(58) Field of Classification Search
CPC ..... B26D 1/553; B26D 3/16; B26D 1/0006
USPC ..... 83/597–612, 331, 663, 673, 932; 30/276, 353, 355
See application file for complete search history.

(56) References Cited

U.S. PATENT DOCUMENTS 50,278 A 10/1865 Sanford et al.
2,717,442 A * 9/1955 Smith ..... 30/151
(Continued)

FOREIGN PATENT DOCUMENTS

DE 155783 C 11/1904
DE 000001695105 U 3/1955
(Continued)

OTHER PUBLICATIONS

German Search Report dated Dec. 9, 2009 for German Patent Application No. 10 2009 006 911.9, 4 pages, English language translation, 5 pages.

*Primary Examiner* — Tu B Hoang
*Assistant Examiner* — Jimmy Chou

(57) ABSTRACT

The invention relates to a blade for cutting food products, in particular sausages, comprising a cutter having two partial cutters disposed tapered toward each other in a curved surface. The invention further relates to a cutting device for cutting food products, having a blade and having a holder on which the blade is rotatably disposed. The cutting device is designed so that an end piece can be sliced off of a product, the longitudinal axis thereof being oriented substantially perpendicular to the axis of rotation of the blade, by a rotary motion of the blade. The invention further relates to a method for processing a food product.

13 Claims, 16 Drawing Sheets

Figure 1:
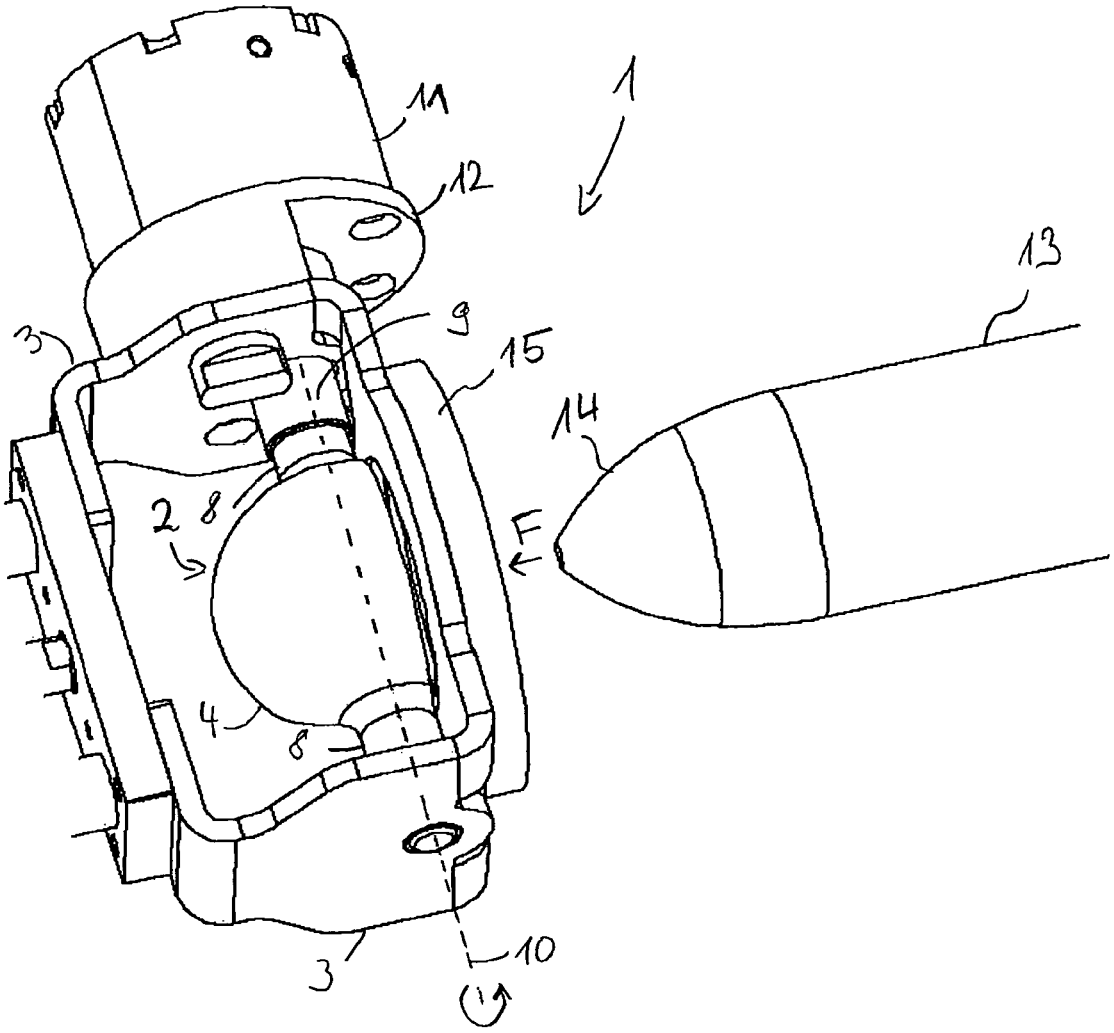

(51) Int. Cl.

| | |
|---|---|
| ***B26D 1/44*** | (2006.01) |
| ***B26D 9/00*** | (2006.01) |
| *B26D 3/16* | (2006.01) |
| *B26D 7/01* | (2006.01) |

(56) References Cited

U.S. PATENT DOCUMENTS

| | | | | | |
|---|---|---|---|---|---|
| 2,737,721 | A | * | 3/1956 | Hart | 83/437.5 |
| 3,024,532 | A | * | 3/1962 | Bettcher | 30/276 |
| 3,139,130 | A | * | 6/1964 | Urschel et al. | 83/13 |
| 3,149,554 | A | * | 9/1964 | Greenspan | 99/534 |
| 3,361,171 | A | * | 1/1968 | Tiby | 83/112 |
| 3,379,234 | A | * | 4/1968 | Kasper | 83/74 |
| 3,658,106 | A | * | 4/1972 | Elsasser | 241/291 |
| 3,915,083 | A | * | 10/1975 | Spruijt | 99/636 |
| 4,098,157 | A | * | 7/1978 | Doyle | 606/138 |
| 4,313,963 | A | * | 2/1982 | Greenspan | 426/58 |
| 4,378,718 | A | * | 4/1983 | Kraft et al. | 83/592 |
| 4,384,406 | A | * | 5/1983 | Tischlinger | 606/138 |
| 4,519,135 | A | * | 5/1985 | LaBounty | 30/134 |
| 4,543,720 | A | * | 10/1985 | Grunikiewicz et al. | 30/277.4 |
| 4,544,397 | A | * | 10/1985 | Fenton | 65/332 |
| 4,667,554 | A | * | 5/1987 | Peery | 83/583 |
| 4,709,481 | A | * | 12/1987 | Moore | 30/356 |
| 4,941,375 | A | * | 7/1990 | Kasper | 83/23 |
| D314,319 | S | * | 2/1991 | Keller | D8/14 |
| 5,129,298 | A | * | 7/1992 | Cresson et al. | 83/72 |
| 5,216,812 | A | * | 6/1993 | Lyons | 30/120.1 |
| 5,217,477 | A | * | 6/1993 | Lager | 606/167 |
| 5,241,887 | A | * | 9/1993 | Wolff et al. | 83/401 |
| 5,331,874 | A | * | 7/1994 | Foster et al. | 83/423 |
| 5,412,873 | A | * | 5/1995 | Gibson | 30/355 |
| 5,423,842 | A | * | 6/1995 | Michelson | 606/167 |
| 5,557,998 | A | * | 9/1996 | Schwartz et al. | 83/875 |
| 5,666,868 | A | * | 9/1997 | Diete et al. | 83/168 |
| 5,745,999 | A | * | 5/1998 | Zirkiev | 30/278 |
| 5,896,801 | A | * | 4/1999 | Jacko | 83/865 |
| 6,413,566 | B2 | * | 7/2002 | Caridis et al. | 426/518 |
| 6,442,844 | B1 | * | 9/2002 | Grunikiewicz et al. | 30/272.1 |
| 6,474,210 | B1 | * | 11/2002 | Nel et al. | 83/768 |
| 6,537,050 | B1 | * | 3/2003 | Kasai et al. | 425/67 |
| 6,558,725 | B2 | * | 5/2003 | Giraldo et al. | 426/438 |
| 6,637,116 | B1 | * | 10/2003 | Hill | 30/253 |
| 7,216,575 | B2 | * | 5/2007 | Alseth et al. | 83/609 |
| 7,455,084 | B2 | | 11/2008 | Ahn et al. | |
| 8,596,173 | B2 | * | 12/2013 | Fung | 83/13 |
| 8,707,840 | B2 | * | 4/2014 | Weber | 83/508.2 |
| 2002/0162434 | A1 | * | 11/2002 | Acosta | 83/13 |
| 2005/0005745 | A1 | * | 1/2005 | Akins et al. | 83/13 |
| 2005/0034312 | A1 | * | 2/2005 | Ai | 30/353 |
| 2006/0219069 | A1 | * | 10/2006 | Skaar et al. | 83/13 |
| 2007/0237589 | A1 | | 10/2007 | Müller | |
| 2008/0028906 | A1 | * | 2/2008 | Reddell et al. | 83/122 |
| 2008/0314215 | A1 | * | 12/2008 | Gursel | 83/356.3 |
| 2010/0107843 | A1 | * | 5/2010 | Lefavour et al. | 83/600 |
| 2010/0263218 | A1 | * | 10/2010 | Bookhamer | 30/298.4 |

FOREIGN PATENT DOCUMENTS

| | | | |
|---|---|---|---|
| DE | 2451313 | A1 | 10/1974 |
| DE | 10333062 | A1 | 7/2003 |
| DE | 20317848 | U1 | 11/2003 |
| DE | 102005050041 | B3 | 10/2005 |
| EP | 0472825 | A1 | 5/1991 |
| EP | 0509477 | A1 | 4/1992 |
| EP | 1350724 | A2 | 3/2003 |
| EP | 1767096 | A1 | 9/2005 |
| FR | 2364097 | A1 | 7/1977 |
| FR | 2565883 | | 12/1985 |
| GB | 2204480 | A | 5/1987 |

* cited by examiner

BLADE FOR PROVIDING A CUT AT FOOD PRODUCTS

CROSS-REFERENCE TO RELATED APPLICATIONS

This is a national stage application of and claims priority from International Application No. PCT/EP2009/009091, filed Dec. 17, 2009, entitled "BLADE FOR CUTTING FOOD PRODUCTS," which claims priority from German Patent Application No. DE 10 2009 006 911.9, filed Jan. 30, 2009, entitled "BLADE FOR CUTTING FOOD PRODUCTS," both of which are fully incorporated herein by reference.

The present invention relates to a blade for providing a cut at food products, in particular at sausages, which includes a cutting blade. The invention further relates to a cutting apparatus for providing a cut at food products having a blade and a support at which the blade is arranged rotatable about an axis of rotation. The invention furthermore relates to an apparatus and to a method for the processing of food products.

Blades of the initially named kind are known and are used for providing cuts at food products, such as sausages, meats or cheeses. In particular in the food product industry known blades are used, for example in association with peeling stations for rod-shaped sausages, to generate a defined cut at a sausage to be peeled. In this respect the cut is made, for example, in an end-side tip section of the sausage, in that the sausage is moved past a blade of the initially named kind on the supply of the sausage to be peeled and an end piece of the sausage is cut off by the blade. The sausage can be processed further due to the defined cut which was made with the blade. In particular grippers of the peeling station can grip the peel of the sausage at the defined cut. The sausage is then conveyed relative to the grippers into the peeling station and in this respect the peel is pulled off from the sausage. The peeled sausage can then, for example, be supplied to a slicer which then cuts the sausage into slices.

It is the object of the present invention to improve the cutting of food products.

This object is satisfied by the features of the independent patent claims. Improvements and embodiments of the invention are specified in the dependent claims.

In accordance with the invention a blade for providing a cut at food products having a cutting blade is provided which has two blade parts which are arranged in a curved surface tapering towards one another.

A product can be cut particularly reliably and a peel, which surrounds the product, can be particularly reliably perforated by means of the blade in accordance with the invention. The blade in accordance with the invention is also advantageous in that a particularly smooth cut can be realized at a food product therewith. Thereby, in particular only a minimal or even no contamination is caused at the product to be cut, so that the danger of contamination of the product surface generated by the cut is minimized.

Furthermore, a particularly small product end is cut off from the product due to the shape of the blade in accordance with the invention. As the product end generally arises as waste, the waste arising on use of the blade in accordance with the invention for making a cut is reduced.

The blade parts, which in particular are of equal length, preferably form a tip in the curved surface. By means of the tip the peel surrounding the product can be perforated particularly reliable to make a cut.

In accordance with an embodiment of the invention the blade has a blade body at which the cutting blade is arranged.

The blade body is designed as partially spherical or as shell-like at least in regions thereof. Insofar the shape of the blade body results from the curved surface in accordance with this embodiment. The blade body is preferably made of a solid material, in particular of metal. A particularly stable blade can be realized whose blade body is not deformed beyond an allowable amount also for heavy use through the partially spherical shape or shell-like shape, on the one hand, and through the use of a solid material, on the other hand.

In accordance with a further preferred embodiment of the invention the blade parts are formed as an extension of a partially spherical region or of a shell-like region of a blade body, the extension tapering to a point. The blade is, in particular symmetrically formed with regard to a plane in which a tip formed by the blade parts lies.

In accordance with a further preferred embodiment of the invention the blade has means for a rotary attachment of the blade to a support, so that the blade is rotatable around an axis of rotation when it is arranged at the support.

This blade is particularly suitable to manufacture a cut at a product end. In particular only due to the rotary movement of the blade about the axis of rotation one can penetrate into an effective region of the blade and the product end can be cut off with the two blade edges. Hereby it is advantageous that, apart from a mechanical system for the rotary movement of the blade relative to the product, no further devices for manufacturing a cut are required.

A cutting apparatus for providing a cut at food products is further provided in accordance with the invention, which has a blade and a support at which the blade is arranged rotatable about an axis of rotation. The cutting apparatus in accordance with the invention is designed so that an end piece of a product, in particular of a rod shaped food product, whose longitudinal axis is substantially perpendicular to the axis of rotation of the blade, is cut off by means of a rotational movement of the blade.

It is an advantage of the cutting apparatus in accordance with the invention that a cut can be manufactured at a product alone through a rotary movement of the blade relative to the product arranged in an effective region of the blade.

The blade preferably has a cutting blade for cutting off the end piece which is arranged in a forward region of the blade with regard to the direction of the rotational movement.

The blade notably has a cutting blade for cutting off the end piece which is arranged spaced apart from the rotary axis of the blade and has an extent in the direction of the axis of rotation of the blade. Metaphorically speaking the blade is therefore arranged relative to the axis of rotation such that the cutting blade is moved at least partially along a surface of an imaginary body on a rotating blade and in this respect severs a product along this surface.

The blade preferably has a cutting edge for cutting off the product end piece and has two bearing sections spaced apart from one another which define an axis of rotation of the blade and which are rotatably supported in counter sections of the support. In this respect the cutting blade is preferably arranged between the bearing sections.

In accordance with a further preferred embodiment of the invention the cutting apparatus has a retaining bracket for a product to be cut. On cutting off of the end piece the product can be held in a predefined position and/or the movability of the products can be limited in at least one direction by means of the retaining bracket.

The retaining bracket is preferably designed in the form of a ring-shaped cuff. The cuff preferably has an interior diameter which is smaller than the outer diameter of a food product to be cut. The ring-shaped cuff can thus, on the one hand, serve as a reception for a cup-shaped end piece of the food product and, on the other hand, serve as an abutment for the food product.

Furthermore, an apparatus for the processing of food products having a blade in accordance with the invention and/or a cutting apparatus in accordance with the invention is provided. The apparatus in accordance with the invention preferably further has a product feed unit. The product feed unit is configured to bring a product into an effective region of the blade, to cut off an end piece from the product using the blade. For this purpose the product feed unit is notably designed to move the product having a product longitudinal axis orientated substantially perpendicular to an axis of rotation of the blade.

Furthermore, a method for the processing of a food product, in particular for providing a cut at a sausage, by means of a cutting apparatus in accordance with the invention is provided in which a product, in particular a rod shaped product, whose longitudinal axis is orientated substantially perpendicular to the axis of rotation of the blade, is brought into the effective region of the blade situated in a waiting position by means of a product feed unit. Subsequently, the blade is rotated about the axis of rotation starting from the waiting position and an end piece is cut off from the product by means of the blade through the rotatary movement. The cut product is preferably peeled, in particular directly after the cutting off of the end piece.

Figure 2:
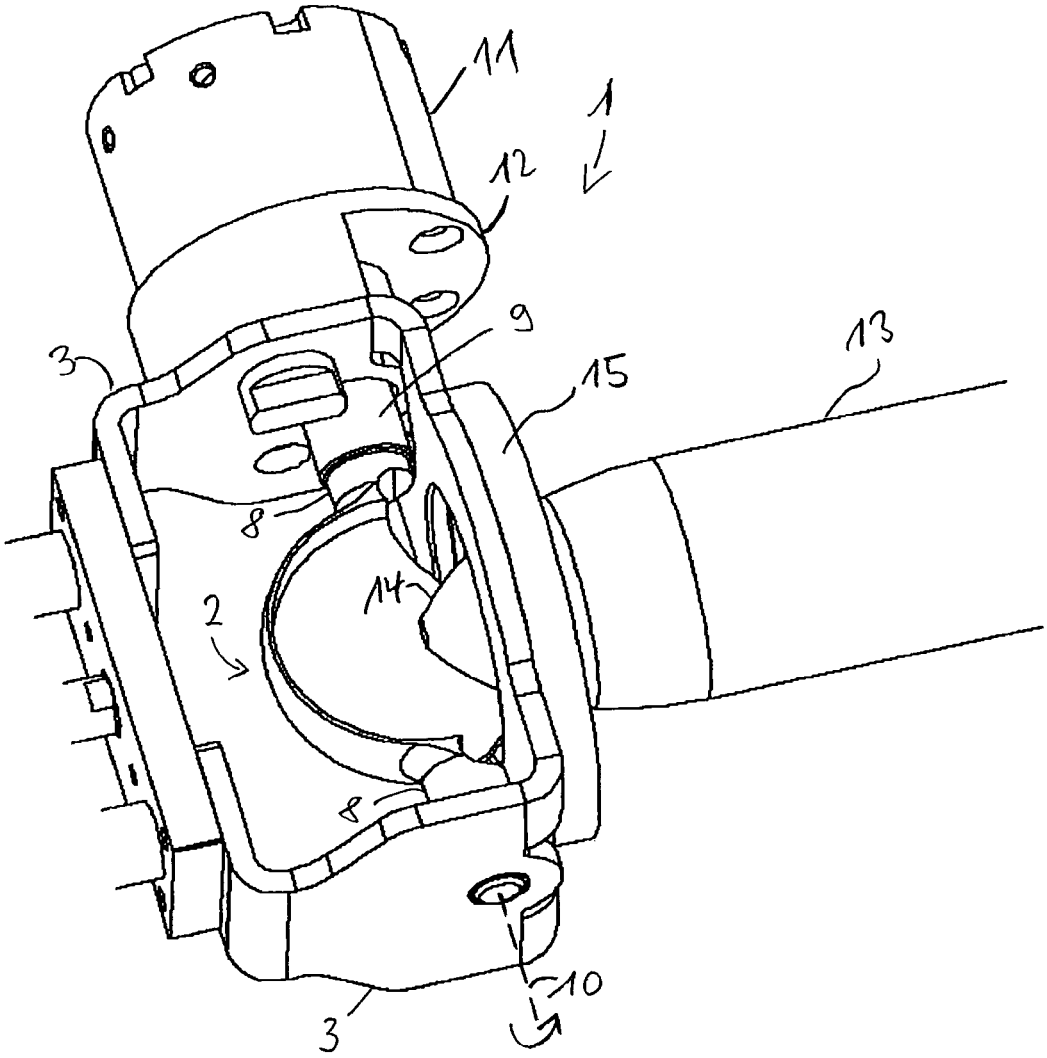
Figure 3:
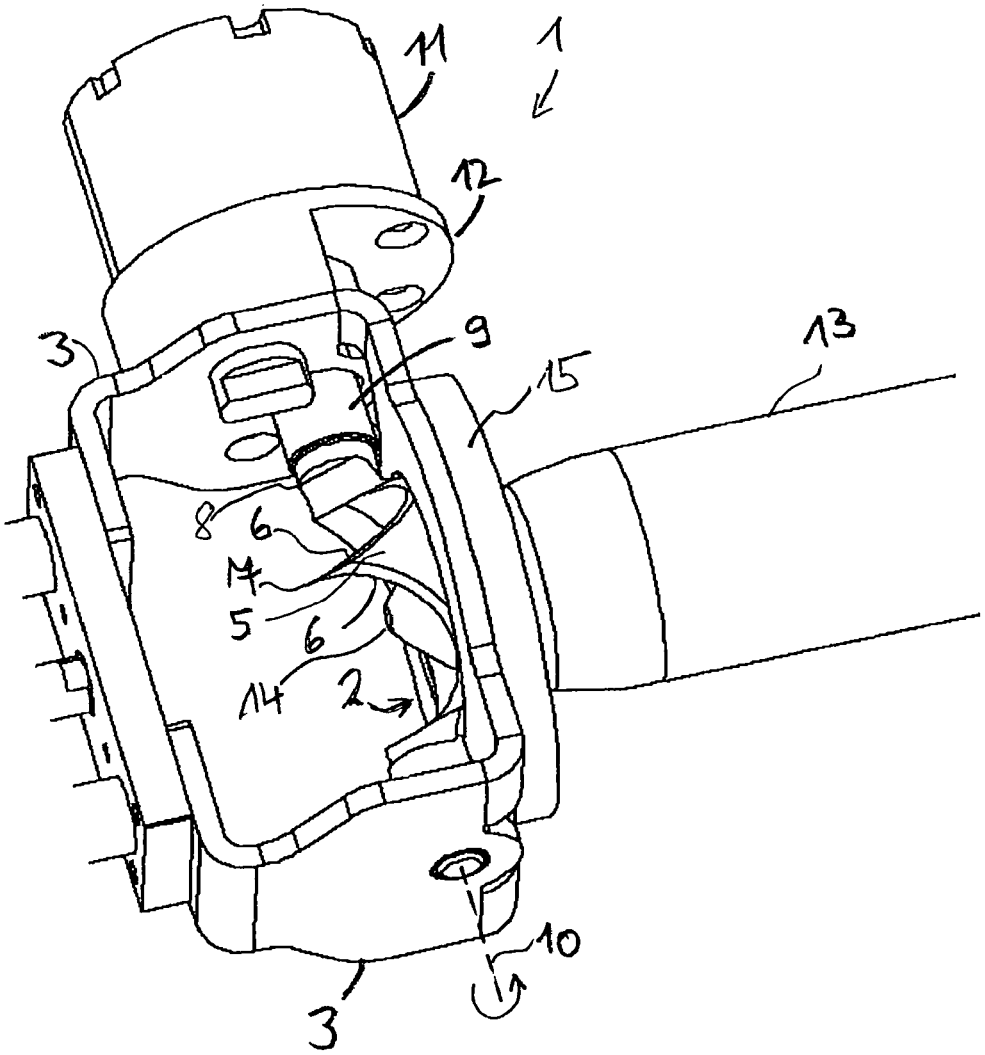
Figure 4:
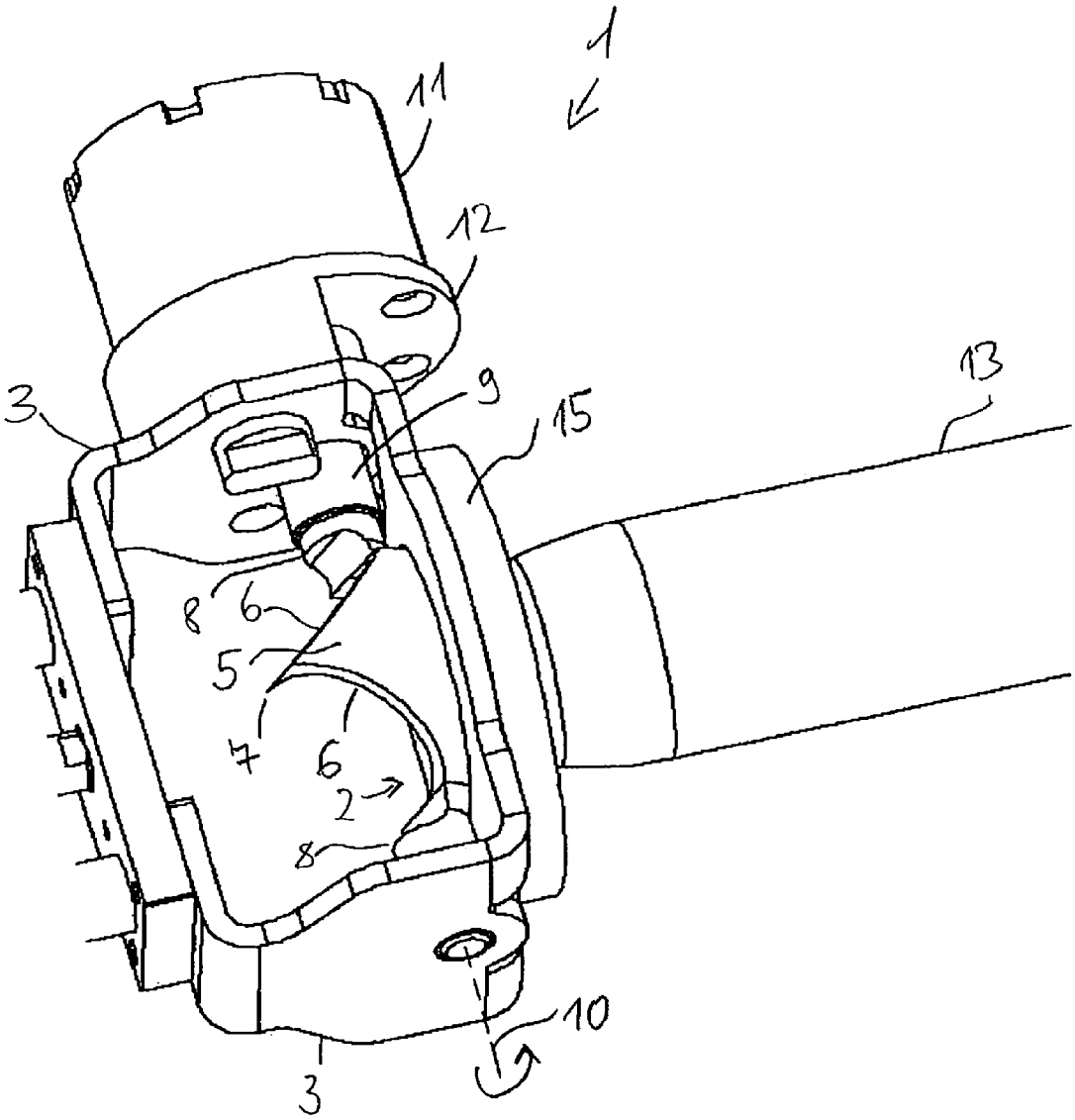
Figure 5:
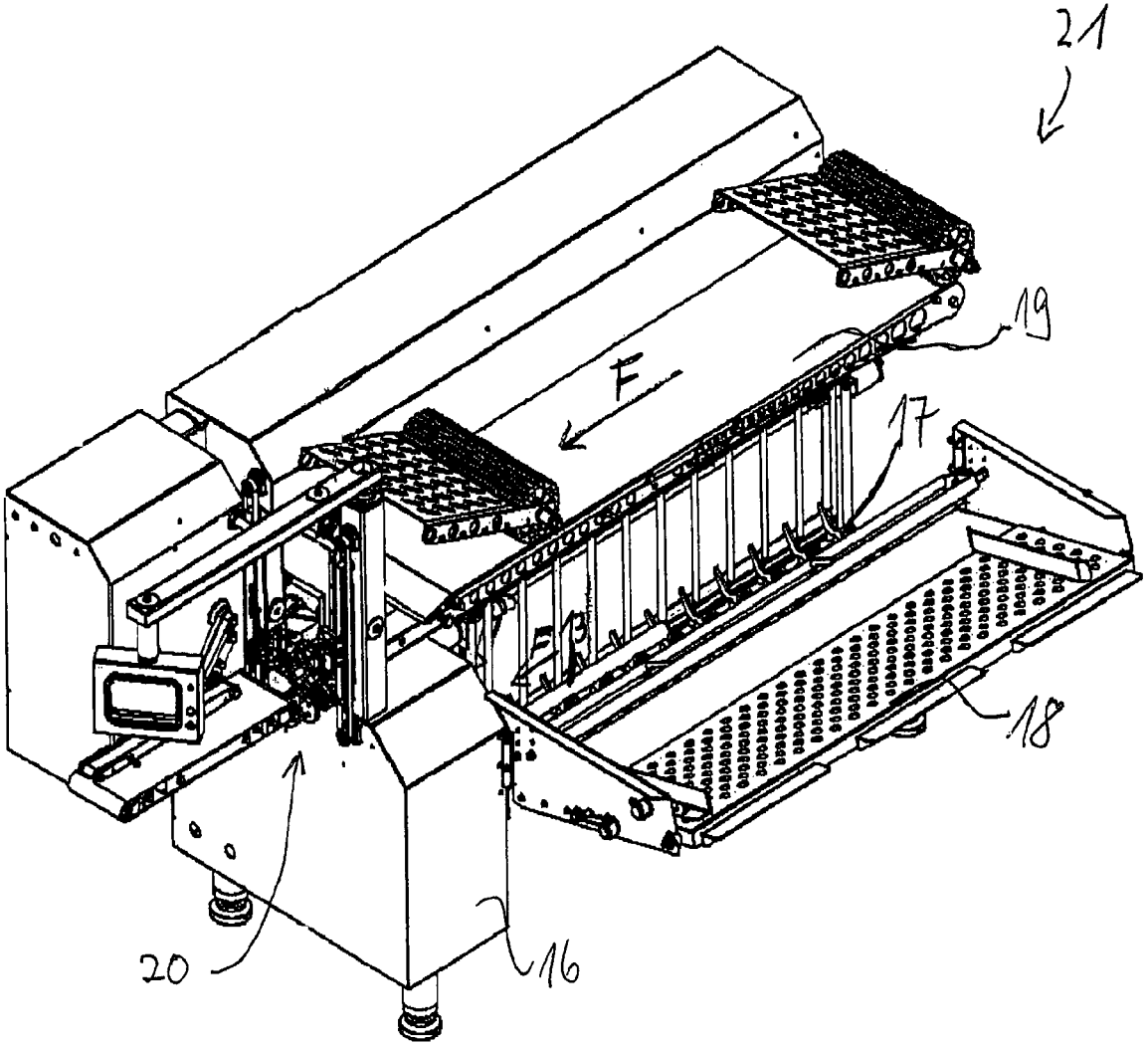
Figure 6:
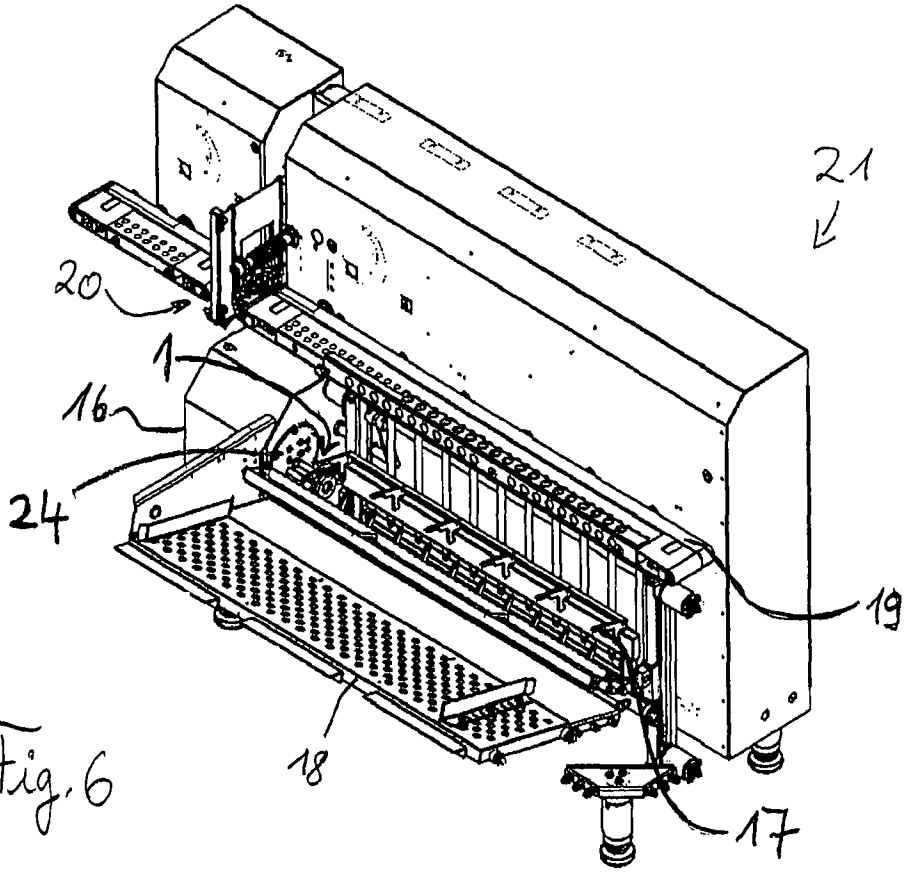
Figure 7:
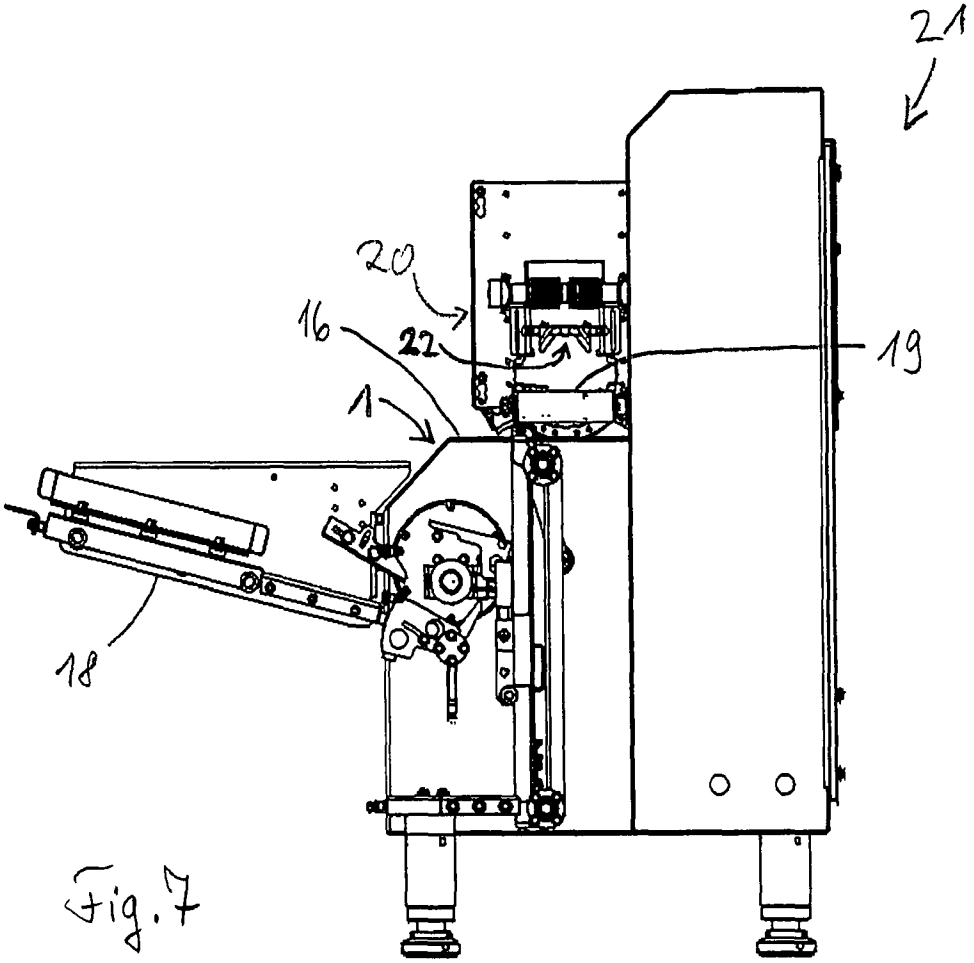
Figure 8:
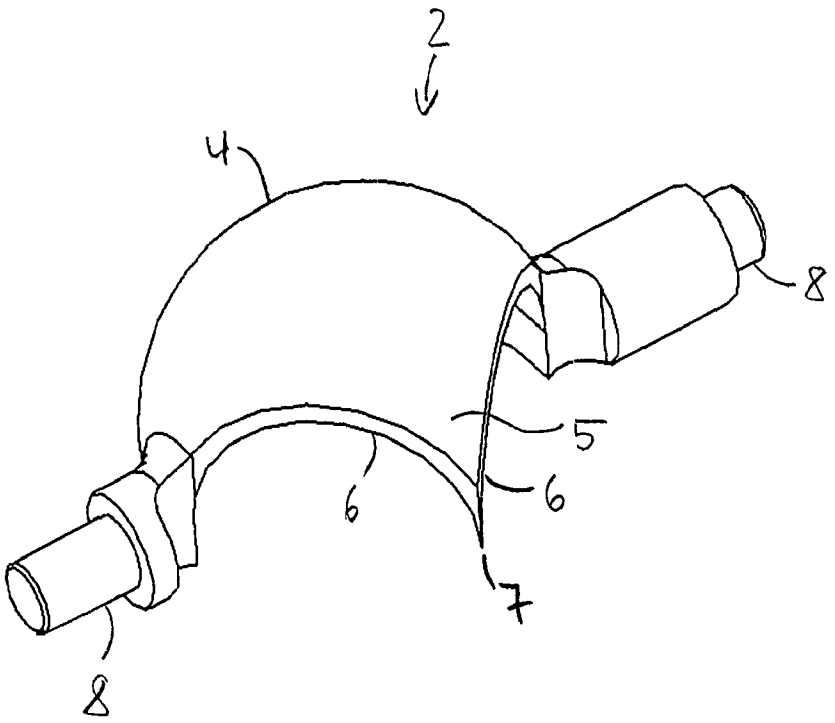
Figure 9:
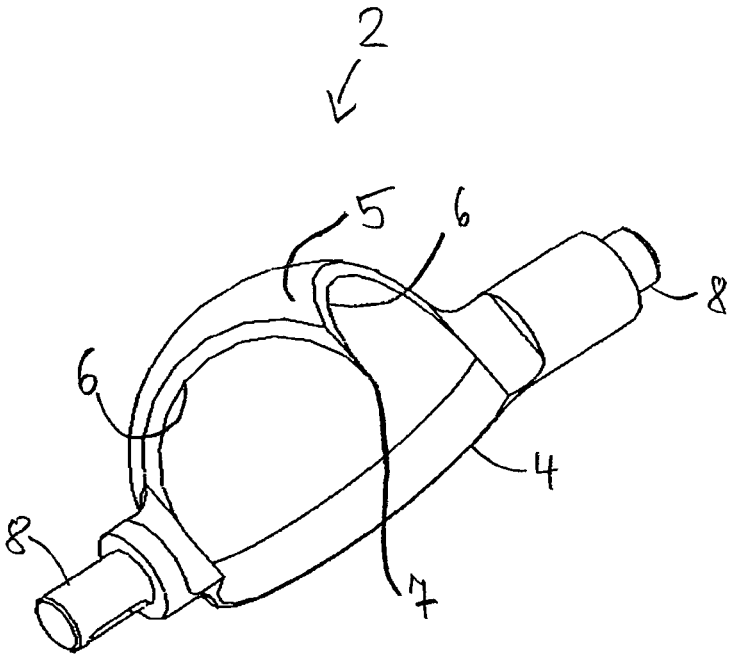
Figure 10:
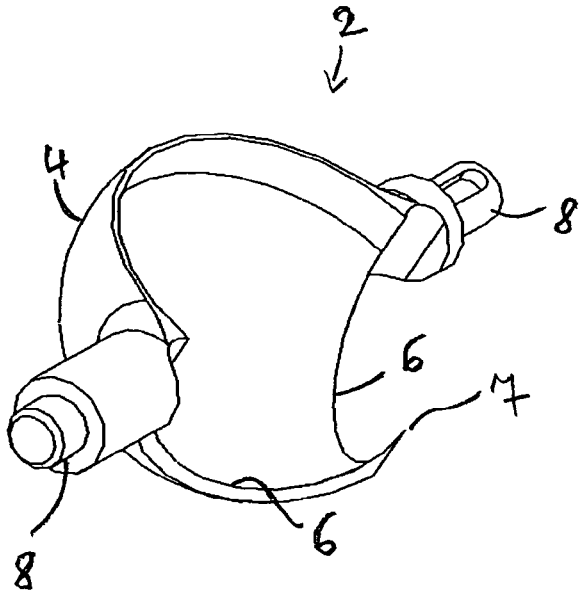
Figure 11:
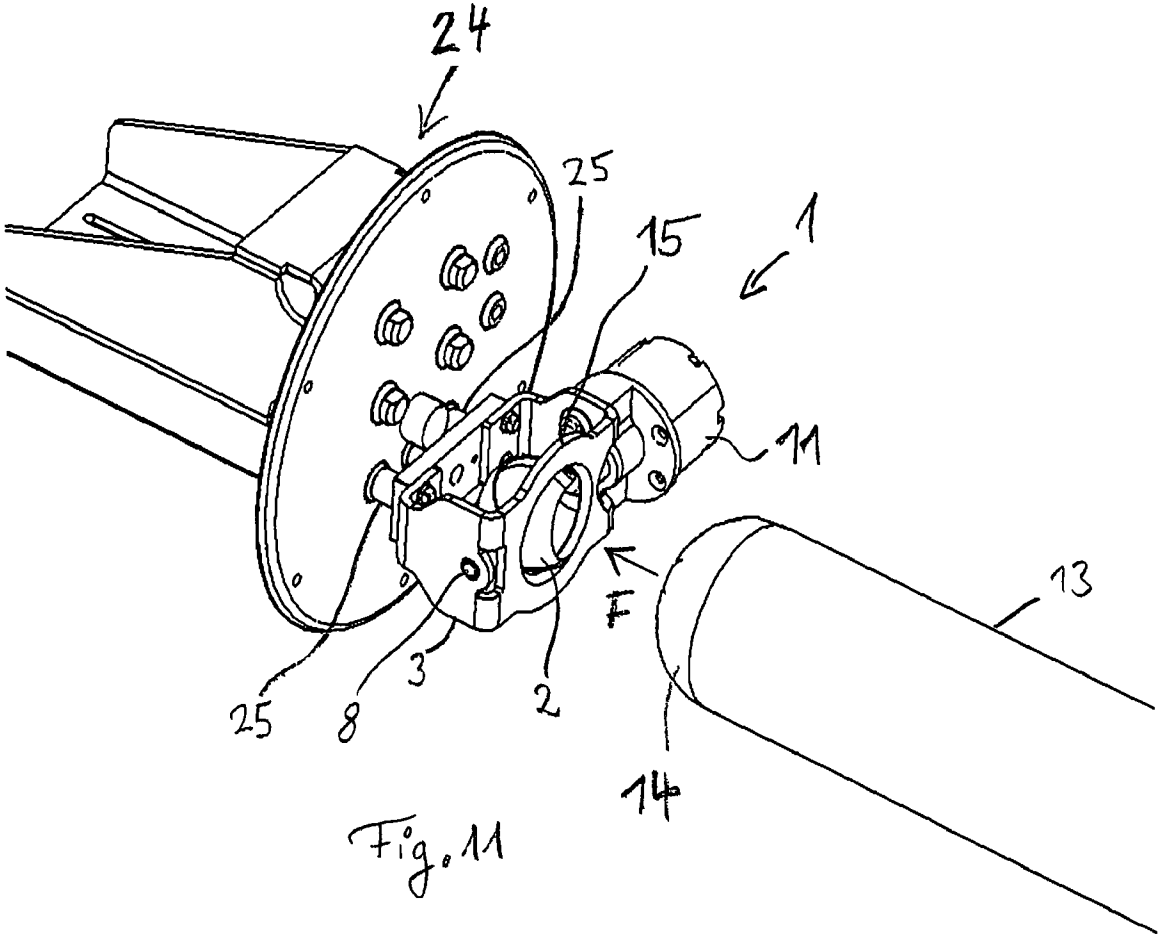
Figure 12:
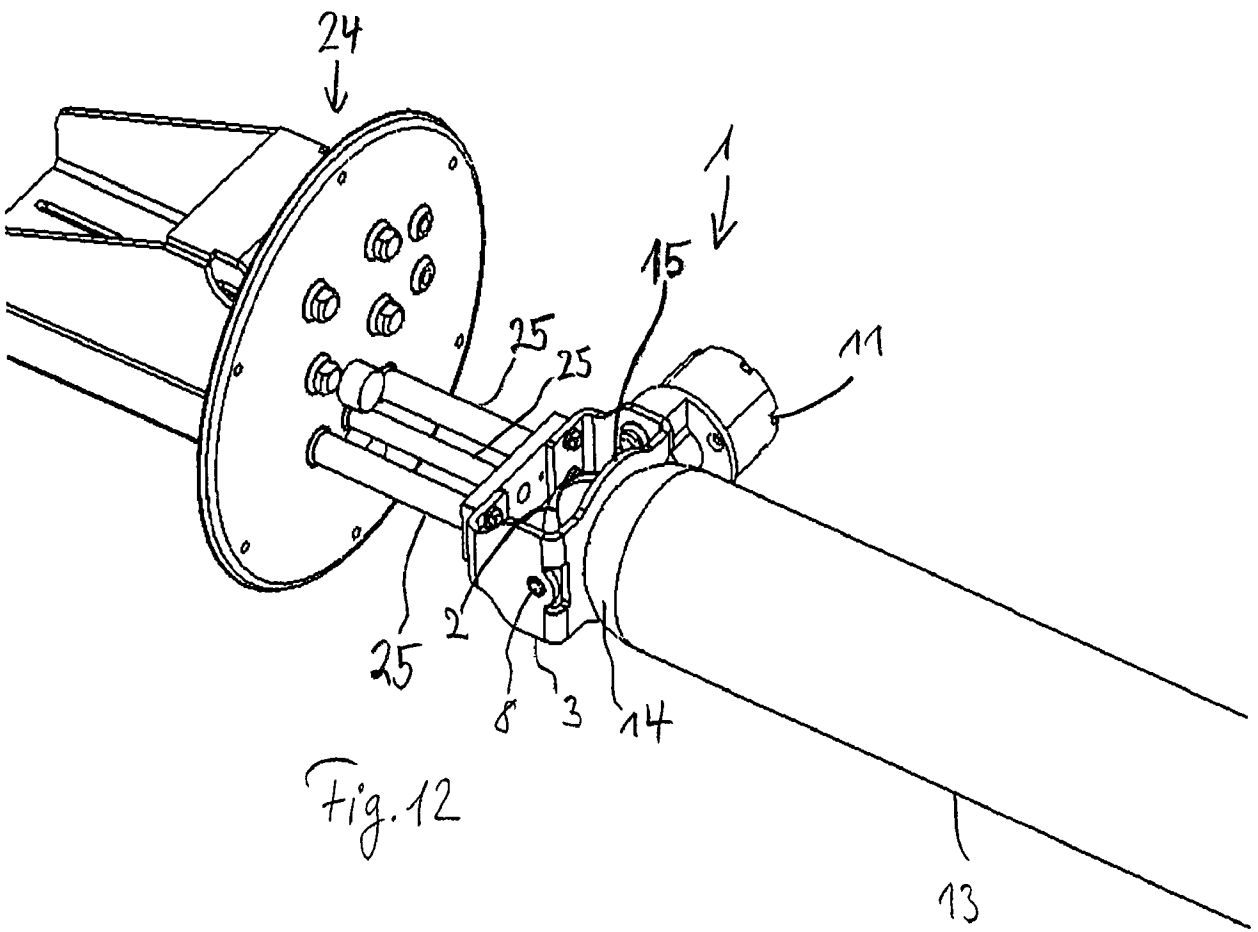
Figure 13:
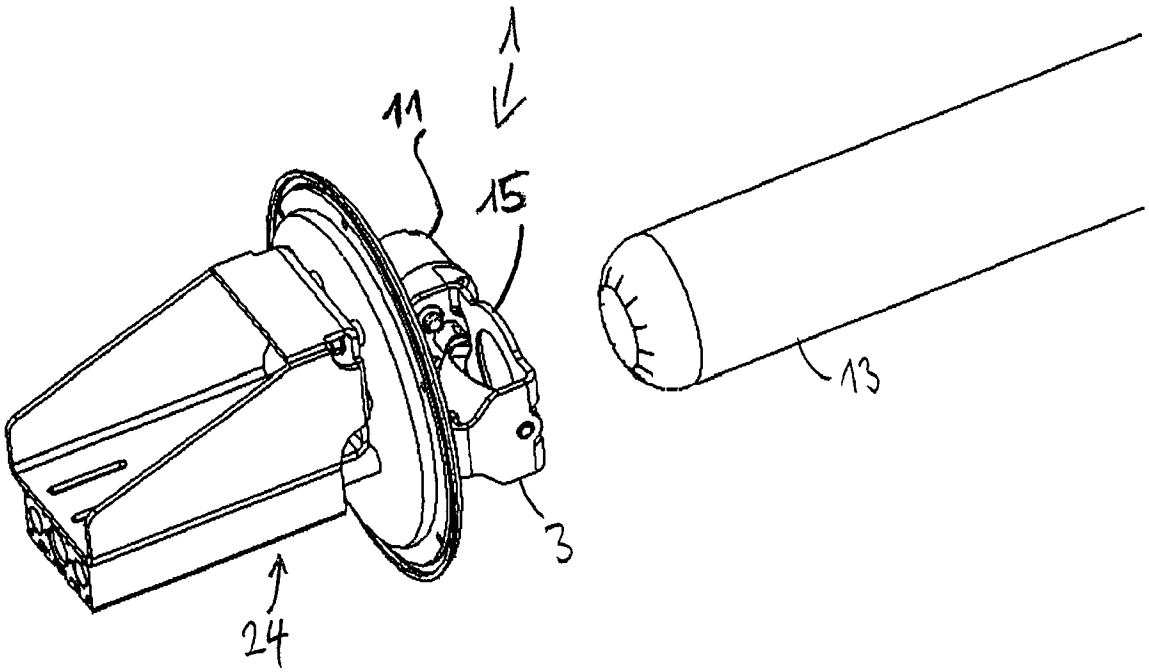
Figure 14:
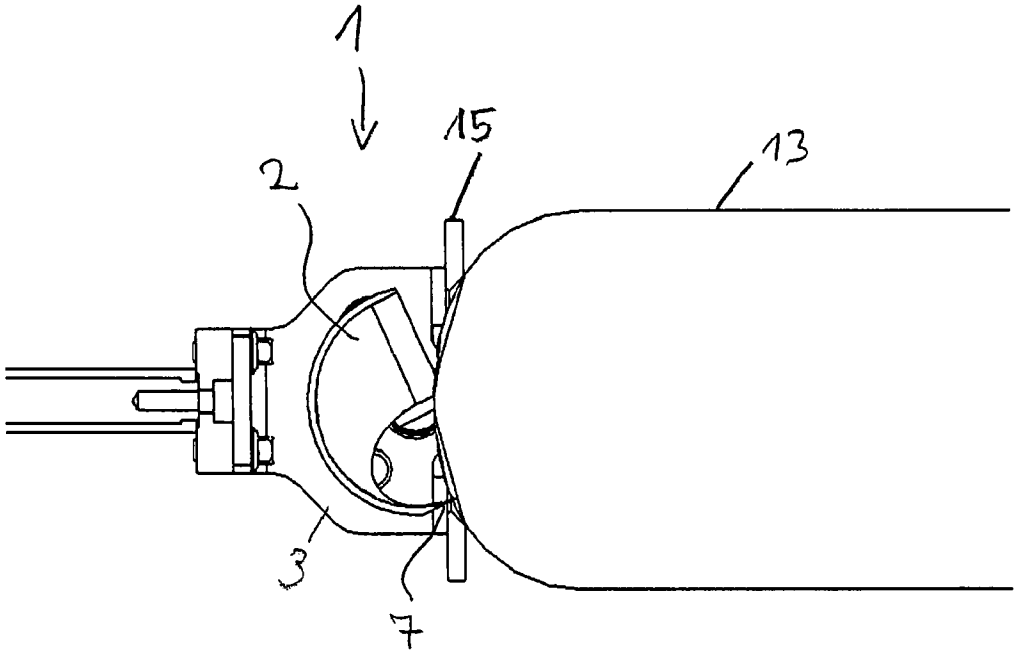
Figure 15:
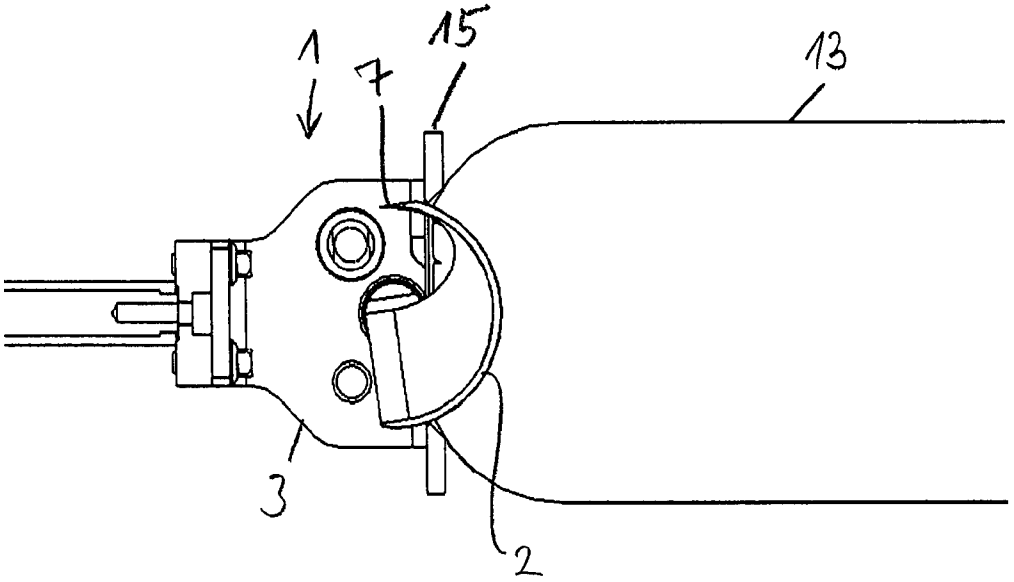
Figure 16:
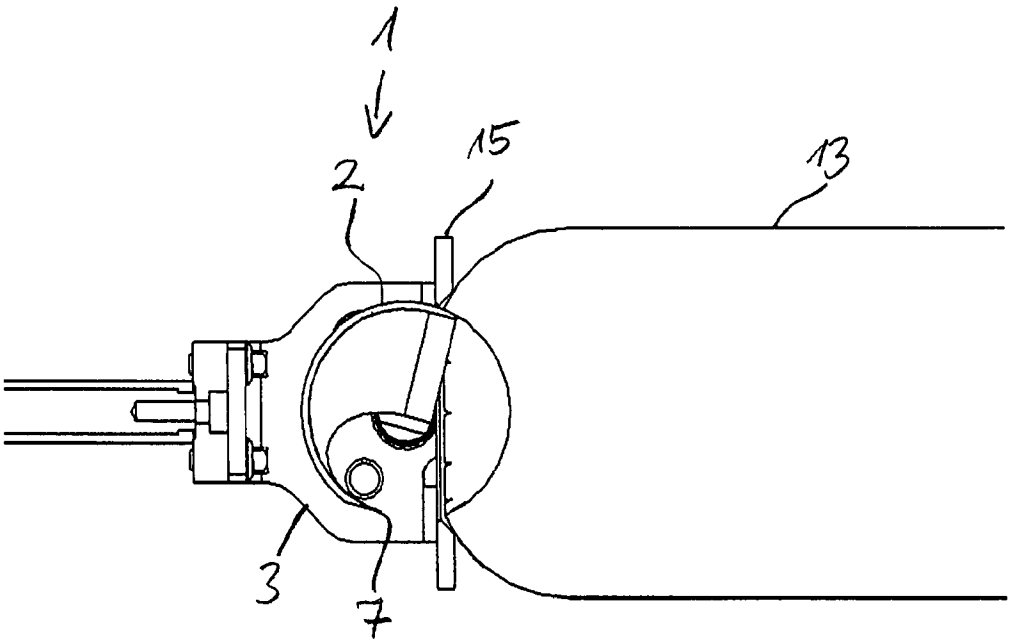

In the following the invention will be described by means of advantageous embodiments and with reference to the submitted drawings. There is shown:

FIG. 1 a perspective view of a cutting apparatus in accordance with the invention having a blade situated in a waiting position;

FIG. 2 a further perspective view of the cutting apparatus in accordance with the invention of FIG. 1, wherein the blade has been rotated out of the waiting position, FIG. 3 a further perspective view of the cutting apparatus in accordance with the invention of FIG. 1, wherein the blade has been turned further with regard to the position shown in FIG. 2;

FIG. 4 a further perspective view of the cutting apparatus of FIG. 1, wherein the blade has been turned even further with regard to the position shown in FIG. 3 and thereby an end piece of the sausage has been cut off;

FIG. 5 a perspective view of an apparatus for peeling of sausages in accordance with the invention;

FIG. 6 a further perspective view of the apparatus of FIG. 5;

FIG. 7 a side view of the apparatus of FIG. 5;

FIG. 8 a perspective view of the blade in accordance with the invention of the cutting apparatus of FIG. 1;

FIG. 9 a further perspective view of the blade of FIG. 8;

FIG. 10 another further perspective view of the blade of FIG. 8;

FIG. 11 a perspective view of a cutting apparatus in accordance with the invention;

FIG. 12 a further perspective view of the cutting apparatus of FIG. 11, wherein a sausage has arrived in the effective region of a blade in accordance with the invention;

FIG. 13 a further perspective view of the cutting apparatus of FIG. 11, wherein an end piece has been cut off from the sausage and the sausage has again been removed out of the effective region of the blade;

FIG. 14 a cross-sectional view of a cutting apparatus in accordance with the invention, in which the blade is arranged in the waiting position and in which a sausage has been brought into the effective region of the blade;

FIG. 15 a further cross-sectional view of the cutting apparatus of FIG. 14, wherein the blade has been turned further with regard to the position shown in FIG. 14;

FIG. 16 a further cross-sectional view of the cutting apparatus of FIG. 14, wherein the blade has been turned even further with regard to the position shown in FIG. 15 and thereby an end piece has been cut off from the sausage.

The same reference numerals are always used for elements corresponding to one another in FIGS. 1 to 16.

The cutting apparatus 1 shown in FIGS. 1 to 4 has a blade 2 and a support 3 at which the blade 2 is rotatably arranged.

The blade 2 has a blade body 4 which is formed shell-like and two blade parts 6 are arranged at the blade body at an extent 5 tapering to a point (FIGS. 3 and 4).

Due to the shell-like design of the blade body 4 and the extent 5 tapering to a point, the two blade parts 6 lie in a curved surface and extend towards one another in the direction of the extent 5 which tapers to a tip 7. In this respect the two blade parts 6 are of equal length.

Two bearing pins 8 spaced apart from one another are further arranged at the measurement body 4, which bearing pins are stored in recesses 9 provided for this purpose at the support 3, so that the blade 2 is rotatably stored about the axis of rotation 10 defined by the bearing pins 8. In particular an electric drive 11 is provided for driving the blade 2 which is arranged at a flange 12 of the support 3.

In the view shown in FIG. 1 the blade 2 is situated in a waiting position. A product feed unit, not illustrated in detail in FIGS. 1 to 4, conveys a sausage 13, whose longitudinal axis is aligned perpendicular to the axis of rotation 10 of the blade 2, along the feed direction F marked in FIG. 1. Thereby an end piece 14 of the sausage 13 arrives in the effective region of the blade 2 which is indicated in FIG. 2.

The sausage can be surrounded by a peel, so that the sausage 13 is supplied to the blade 2 to make a defined cut by cutting off the end piece 14 by means of the blade 2, at which cut grippers 22 of a peeling station 20 (c.f. in particular FIG. 7) grip the peel and can remove this peel from the sausage 13. An advantage of the invention is that a peel to be pulled off can be detected particularly well and reliably by the automatic grippers 22 at a cut made by means of the blade 2 in accordance with the invention.

The blade 2 is rotated against the clock-wise direction about the axis of rotation 10 with regard to the views shown in FIGS. 1 to 4. In this respect the tip 7 penetrates the peel of the sausage 13 and the blade parts 6, arranged at both sides of the tip 7, cut off the end piece 14 from the sausage 13 which is, in particular evident from FIGS. 3 and 4.

The support 3 has a retaining bracket 15 which forms an abutment for the sausage 13, to hold the sausage 13 in the desired position and/or to prevent that the sausage escapes upwards. In particular the retaining bracket 15 forms an abutment for the sausage 13 with regard to the feed direction F. Thereby the end piece 14 of the sausage 13 is positionable in a predefined position and in a reproducible manner relative to the blade 2 arranged in the waiting position.

As is evident, in particular from FIG. 4, the end piece of the sausage 13 is cut off once the blade has run through its effective region starting from the waiting position shown in FIG. 1. The blade 2 can subsequently be rotated further—possibly with a stop in the waiting position—to cut the next sausage.

Once the end piece 14 has been cut off, the cut sausage 13 is moved against the feed direction F, in particular to subsequently move the cut sausage 13 in a direction transverse to the feed direction F without the cut sausage 13 coming into contact with the retaining bracket 15. Following the cutting off of the end piece 14, the cut sausage 13 is, for example, supplied to the peeling station already mentioned above through a further feed movement which peels the sausage 13 starting from the cut.

The apparatus 21 in accordance with the invention shown in FIGS. 5 to 7 includes a cutting apparatus, as has been described in FIGS. 1 to 4 by way of example, arranged at a housing 16. The apparatus 21 further has a product feed unit 17 and a reception 18 arranged therein. Sausages placed on the reception 18 arrive in the product feed unit 17 one after the other due to a slope in the reception 18.

The product feed unit 17 is configured to convey the sausage 13 (cf. FIG. 5) in the feed direction F for this purpose, wherein the sausage 13 is orientated perpendicular to the axis of rotation of the blade of the cutting apparatus in accordance with the invention arranged at the housing 16. Once an end piece 14 has been cut off from the sausage 13 by the cutting apparatus in accordance with the invention, as was previously described e.g. with regard to FIGS. 1 to 4, the product feed unit 17 transfers the cut sausage 13 to a conveyer belt 19 which supplies the cut sausage 13 in the feed direction F to the peeling station 20 for peeling the sausage 13. The peeling station 20 includes the grippers 22 which grip the peel in the provided cut of the sausage 13. The sausage 13 is then guided below the grippers 22, wherein the peel is removed from the sausage 13. Generally also other food products other than sausages can be cut by means of the blade in accordance with the invention and/or by means of the cutting apparatus in accordance with the invention. The application of the invention is furthermore not restricted to a preparation for peeling. The cutting can rather also serve for other purposes.

As can be particularly clearly recognized from FIGS. 8 to 10 the blade body 4 of the blade 2 is formed partially shell-like and includes the extent 5 tapering to a point having the tip 7 and the two blade parts 6. It is further evident that the blade 2 is designed symmetric with regard to a plane. In this respect the tip 7 lies in the plane and the axis of rotation of the blade 2 defined by the bearing pins 8 runs perpendicular to this plane.

The cutting apparatus 1 shown in FIGS. 11 to 13 can be arranged at the apparatus 21 shown in FIGS. 5 to 7 and can in particular be arranged at the housing 16. Notably a holding apparatus 24 which is fixed at the housing 16 (cf. FIG. 6) and which serves for the holding of supports 25 at which the cutting apparatus 1 is fixed serves for mounting the cutting apparatus 1 at the housing 16. The supports 25 can be movable relative to the holding apparatus 24 in the feed direction F and moveable against the feed direction F of a sausage 13.

The cutting apparatus 1, as is shown in FIG. 11, can be arranged in a park position on the movable supports 25. In this respect the supports 25 are retracted into the holding apparatus 24 so far that the support 3 for the blade 2 almost abuts the holding apparatus 24.

The supports 25 can be driven out of the holding apparatus 24 for making a cut at a sausage 13. In this respect the cutting apparatus 1 is moved against the feed direction F of the sausage 13 until the end piece 14 of the sausage 13 arrives in the effective region of the blade 2 situated in the waiting position (cf. FIG. 12). Alternatively or in addition hereto—as has been described with regard to FIGS. 1 to 4—the sausage 13 can be conveyed in the feed direction F to bring this into the effective region of the blade 2.

Once the end piece has been cut off from the sausage 13 the sausage 13—as described above—can be conveyed to the peeling station 20 (cf. FIGS. 5 to 7). The cutting apparatus 1 can be moved again, through movement of the support 25 against the feed direction F, until the cutting apparatus 1 again arrives in the park position (cf. FIG. 13).

In the view of the cutting apparatus 1 shown in FIG. 14 the sausage 13 has arrived in the effective region of the blade 2 situated in the waiting position. In this respect the retaining bracket 15 forms an abutment for the sausage 13. The blade 2 is then turned out of the waiting position.

In the view shown in FIG. 15 the tip 7 has already perforated the sausage 13 and the blade parts 6 have already partially cut off an end piece from the sausage 13. In the view shown in FIG. 16 the blade 2 has cut off the end piece from the sausage 13. Subsequently the sausage 13—as described above—can be conveyed to a peeling station to peel the sausage 13 starting from the provided cut.

LIST OF REFERENCE NUMERALS

1 cutting apparatus
2 blade
3 support
4 blade body
5 extent
6 blade part
7 tip
8 bearing pin
9 reception
10 axis of rotation
11 drive
12 flange
13 sausage
14 end piece
15 retaining bracket
16 housing
17 product feed unit
18 reception
19 conveying belt
20 peeling station
21 apparatus
22 gripper
24 holding apparatus
25 support

The invention claimed is:

1. The cutting apparatus for providing a cut at a food product (13), the cutting apparatus comprising:

a blade (2); and a support (3) at which the blade (2) is arranged for mechanical rotation about an axis of rotation (10), wherein the cutting apparatus (1) is designed so that an end piece (14) of the food product (13), whose longitudinal axis is substantially perpendicular to the axis of rotation (10) of the blade (2), is cut off by means of a rotational movement of the blade (2), wherein the blade (2) includes a curved blade body having a leading edge, the leading edge including two curved blade edges that taper toward one another to form a tip, and wherein a curved taper is formed between the tip and each of the blade edges.

2. The cutting apparatus in accordance with claim 1, wherein the leading edge is arranged in a frontal region of the blade (2) with regard to a direction of the rotational movement.

3. The cutting apparatus in accordance with claim 1, wherein the leading edge is arranged spaced apart from the axis of rotation (10) of the blade (2) and has an extent in a direction parallel to the axis of rotation (10).

4. The cutting apparatus in accordance with claim 1, wherein the blade (2) has two bearing sections (8) spaced apart from one another which define the axis of rotation (10) of the blade (2), wherein the two bearing sections (8) are rotatably supported in recesses (9) of the support (3).

5. The cutting apparatus in accordance with claim 4, wherein the blade body is situated between the two bearing sections (8).

6. The cutting apparatus in accordance with claim 1, wherein the cutting apparatus (1) has a retaining bracket (15) for the food product (13) to be cut which is designed to hold the food product (13) in a predefined position in at least one direction on cutting off the end piece (14).

7. The cutting apparatus in accordance with claim 1, wherein the tip of the blade (2) forms a point.

8. The cutting apparatus in accordance with claim 1, wherein:

the blade (2) is symmetric with respect to a plane;

the tip of the blade (2) lies in the plane; and the axis of rotation (10) of the blade (2) extends in a direction perpendicular to the plane.

9. The cutting apparatus in accordance with claim 1, further comprising an electric drive that is operable to rotatably drive the blade (2).

10. The cutting apparatus in accordance with claim 4, wherein the support (3) includes opposite sides that form the recesses (9) and a retaining member that extends between and connects the sides of the support (3) and is designed to hold the food product (13) in a predefined position.

11. The cutting apparatus in accordance with claim 10, wherein:

the recesses (9) extend toward one another from the sides of the support (3) in a direction parallel to the axis of rotation;

the support (3) further includes a flange extending from one of the sides in a direction opposite from the direction in which a corresponding one of the recesses (9) extends; and the cutting apparatus further comprising an electric drive arranged at the flange of the support (3) and operable to rotatably drive the blade (2).

12. The cutting apparatus in accordance with claim 1, further comprising:

a housing;

said blade arrange at the housing; and a product feed unit configured to convey the food product (13) to the cutting apparatus in a direction perpendicular to the axis of rotation (10) of the blade (2).

13. The cutting apparatus in accordance with claim 12, further comprising:

a conveyor belt; and a peeling station, wherein the product feed unit is configured to transfer the food product (13) to the conveyor belt, the conveyor belt is configured to supply the food product (13) to the peeling station, and the peeling station is operable to peel the food product (13).

* * * * *